US006513889B1

(12) United States Patent
Park

(10) Patent No.: US 6,513,889 B1
(45) Date of Patent: Feb. 4, 2003

(54) CLEANING TOOL BOX

(76) Inventor: Hyuk Koo Park, 801-801 Beoksan Hansung Apt., 1267 Kwonsun-dong, Kwonsun-gu, Suwon-shi, Kyonggi-do (KR)

( * ) Notice: Subject to any disclaimer, the term of this patent is extended or adjusted under 35 U.S.C. 154(b) by 0 days.

(21) Appl. No.: 09/967,985

(22) Filed: Oct. 2, 2001

(51) Int. Cl.[7] ..... A47G 29/08
(52) U.S. Cl. ..... 312/206; 312/207; 312/213
(58) Field of Search ..... 312/206, 207, 312/209, 210, 211, 212, 213, 257.1; 211/65, 66; 206/209, 209.1, 361, 362, 362.1, 362.2, 362.3, 581

(56) References Cited

U.S. PATENT DOCUMENTS

| | | | | | |
|---|---|---|---|---|---|
| 1,336,345 | A | * | 4/1920 | Cornelius | 312/206 X |
| 2,584,219 | A | * | 2/1952 | Murrell | 312/207 |
| 3,364,838 | A | | 1/1968 | Bradley | |
| 5,350,304 | A | * | 9/1994 | Fula et al. | 312/213 X |
| 5,387,053 | A | | 2/1995 | Williamson | 248/146 |
| 6,042,207 | A | * | 3/2000 | Crosby et al. | 312/257.1 X |
| 6,135,279 | A | * | 10/2000 | Dryer | 206/362.1 |
| 6,237,880 | B1 | | 5/2001 | McNutly | 405/52 |

FOREIGN PATENT DOCUMENTS

| | | | | |
|---|---|---|---|---|
| DE | 219983 | * | 3/1910 | 312/207 |
| FR | 1399139 | * | 4/1965 | 312/206 |

* cited by examiner

*Primary Examiner*—James O. Hansen
(74) *Attorney, Agent, or Firm*—McDermott, Will & Emery

(57) ABSTRACT

A cleaning tool box, the box including a body having a rear panel, left and right panels and upper and lower panels and left and right doors for opening and closing a front opening of the body, the box comprising: a partition panel positioned between the left panel and the right panel and assembled by the upper panel, the lower panel and the rear panel in order to partition an inner space of the body; a shelf positioned between the upper panel and the lower panel and secured by the left panel and the partition panel in order to partition an inner space of the body; a rag fixing rack positioned at an upper end between the right panel and the partition panel and fixed by the shelf, the right panel and the rear panel to allow free access by a rag and to stably secure a handle at the rag; a rag pad positioned between the rag fixing rack and the lower panel and fixed by the shelf and the right panel to allow a head part of the rag to be hitched thereat; and two water containers accommodated on floor of the body, such that filthy water and foreign objects flowing from rag can be instantly emptied from the water containers and drying efficiency of the rag is improved to remove generation of stench and to maintain a constant sanitary state.

5 Claims, 3 Drawing Sheets

CLEANING TOOL BOX

BACKGROUND OF THE INVENTION

1. Field of the Invention

The present invention relates to a cleaning tool box, and more particularly to a cleaning tool box constructed in waste synthetic resin by way of injection molding to enable to remove corrosion and stench, and to allow easy storage and proper arrangement of cleaning tools and to enable to easily drain water remaining thereinside for collection in one place.

2. Description of the Prior Art

Generally, a cleaning tool box is made of wood or steel such that when it is frequently exposed to dust, water and moisture, stench is generated by rust, corrosion, rottenness and the like, resulting in sanitation problems.

Furthermore, the cleaning tool box is not equipped with a gutter so that filthy water remaining on cleaning tools can flow thereinto, prompting to frequently clean an inside floor thereof and causing inconvenience and discomfort.

A cleaning tool box utilizing waste synthetic resin according to the prior art is comprised of a body 1 including side plates, upper plate and doors by way of injection molding, as illustrated in FIG. 1, where floor thereof is installed with synthetic resin mesh 4 while the body 1 is partitioned therein into a plurality of tool accommodation parts 5 and is formed at one upper side thereof with opening 2 formed with a plurality of grooves for dust rags 100 to be input and output, and to be positioned at a predetermined place thereat. The body 1 is mounted thereunder with a gutter 3 for being input and output in drawer way toward front side.

However, there is a problem in the cleaning tool box utilizing waste synthetic resin thus constructed according to the prior art in that floor of the plurality of cleaning tool accommodation parts 5 is installed with waste synthetic resin mesh 4, such that when filthy water containing foreign objects flows from the rags 100 through the mesh 4, the filthy water passes through the mesh 4 to be collected at the gutter 3 but the foreign object, once caught by the mesh 4, stay untouched for a long time, thereby generating stench and degrading the whole sanitary state of the cleaning tool box.

There is another problem in that the gutter 3 mounted underneath the body 1 is input and output in drawer style, so that when the gutter 3 is removed from the body 1 in order to get rid of filthy water collected at the gutter 3, the dirty water collected at the gutter 3 can be split out of unbalance or carelessness.

There is still another problem in that the plurality of accommodation parts 5 installed at doors (not shown) are not mounted with drafts such that ventilation is not properly performed to deteriorate drying of the cleaning tools, thereby resulting in generating stench.

SUMMARY OF THE INVENTION

The present invention is disclosed to solve the aforementioned problems and it is an object of the present invention to provide a cleaning tool box adapted to install a stainless rod-like rag rack inside a body thereof to allow watery dust rag to hang at a predetermined height and to make filthy water and foreign objects remaining at the rag directly drop without being hitched thereat, thereby eliminating generation of stench and enable to maintain a sanitary state at all times.

It is another object of the present invention to provide a cleaning tool box adapted to accommodate a separate water container on a floor inside a body of the box to enable to remove collected filthy water and foreign objects easily.

It is still another object of the present invention to provide a cleaning tool box adapted to install drafts at the rear surface of the body to enable to facilitate ventilation, thereby increasing a drying rate of accommodated cleaning tools and simultaneously removing generation of stench and enabling to maintain a pleasant space at all times.

In accordance with the objects of the present invention, there is provided a cleaning tool box, the box including a body comprised of a rear panel, left and right panels and upper and lower panels and left and right doors for opening and closing a front opening of the body, the box comprising:

a partition panel positioned between the left panel and the right panel and assembled by the upper panel, the lower panel and the rear panel in order to partition an inner space of the body;

a shelf positioned between the upper panel and the lower panel and secured by the left panel and the partition panel in order to partition an inner space of the body;

a rag fixing rack positioned at an upper end between the right panel and the partition panel and fixed by the shelf, the right panel and the rear panel to allow free access by a rag to stably secure a handle at the rag;

a rag pad positioned between the rag fixing rack and the lower panel and fixed by the shelf and the right panel to allow a head of the rag to be hitched thereat; and two water containers accommodated on floor of the body.

BRIEF DESCRIPTION OF THE DRAWINGS

For fuller understanding of the nature and objects of the invention, reference should be made to the following detailed description taken in conjunction with the accompanying drawings in which.

DETAILED DESCRIPTION OF THE INVENTION

Now, a preferred embodiment of the present invention is described in detail with reference to the accompanying drawings.

Figure 1:
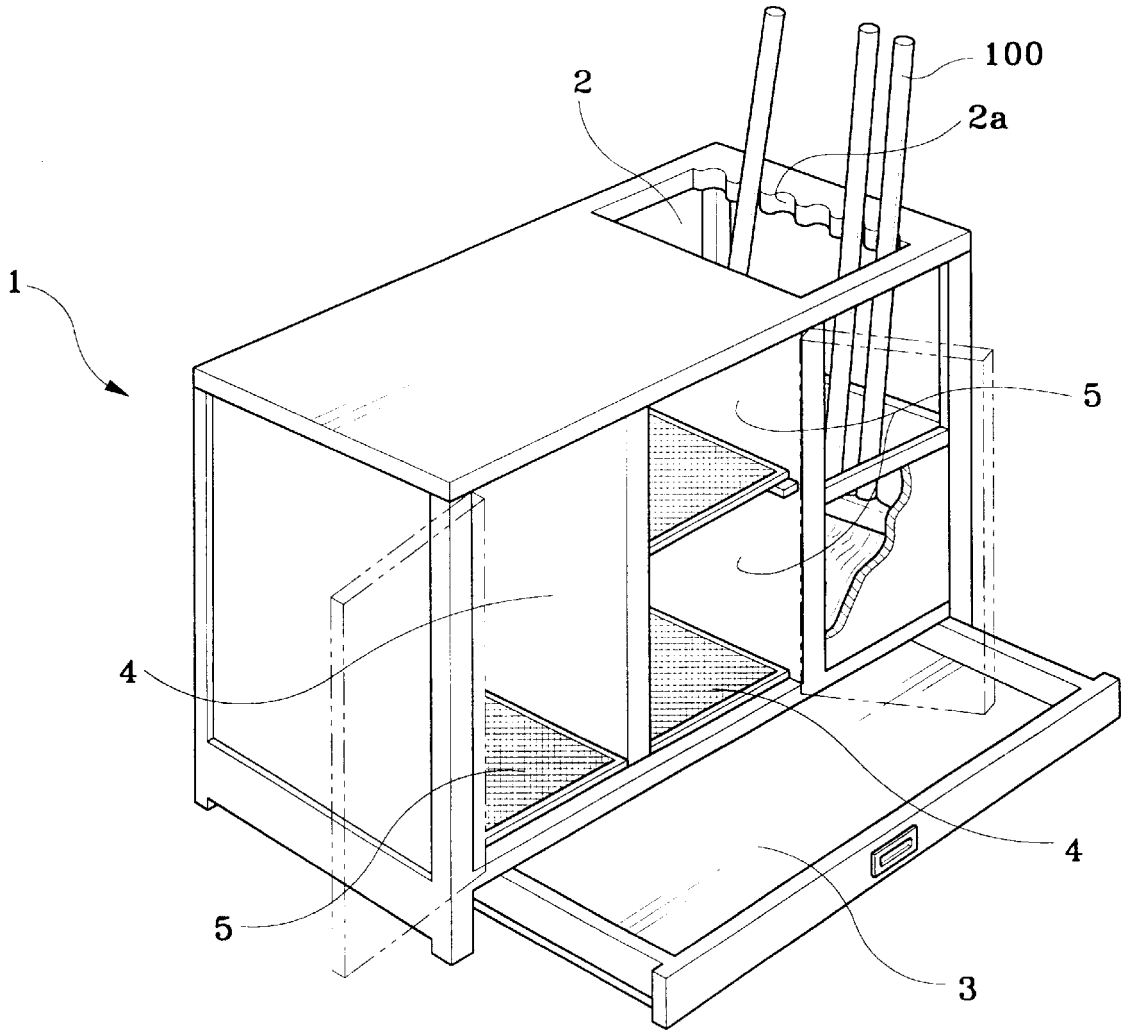
FIG.1 (Prior art)
FIG. 1 is a perspective view for illustrating a cleaning tool box according to the prior art.
Figure 2:
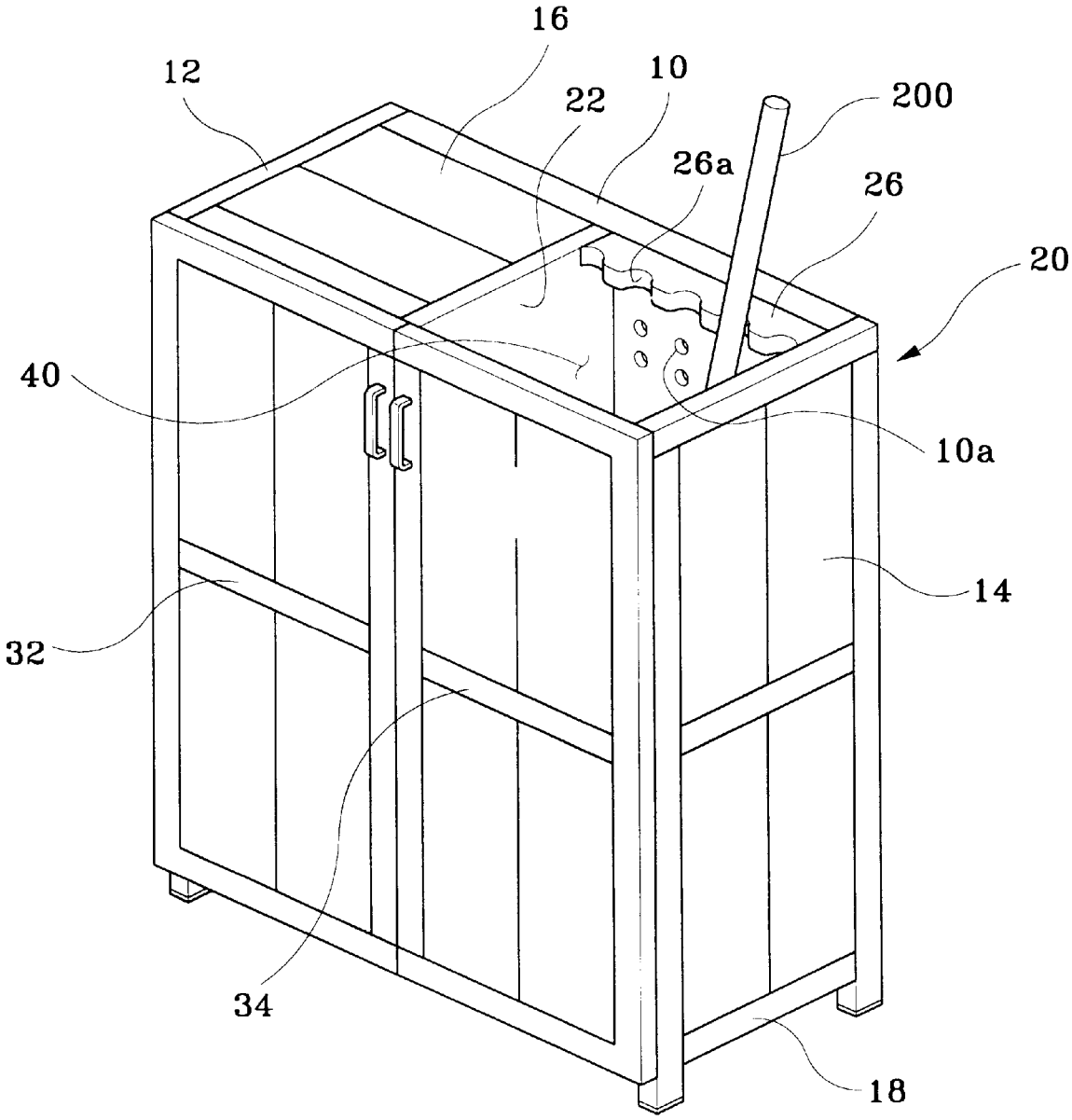
FIG. 2 is a perspective view for illustrating a cleaning tool box according to the present invention where doors are closed.
Figure 3:
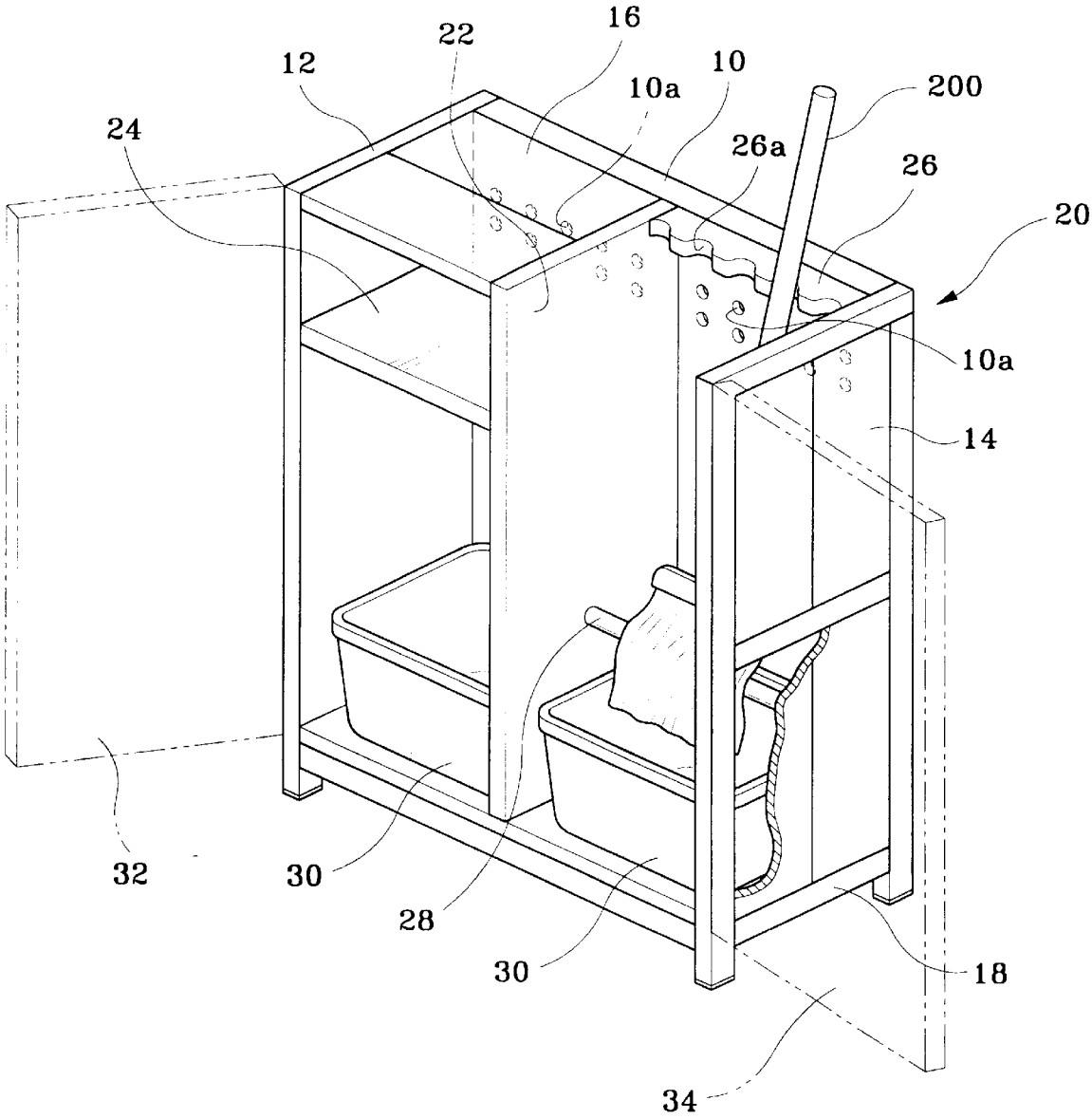
FIG. 3 is a perspective view for illustrating a cleaning tool box according to the present invention where doors are opened.

Throughout the drawings in FIGS. 2 and 3, like reference numerals are used for designation of like of equivalent parts or portions for simplicity of illustration and explanation, whereby redundant references will be omitted.

As illustrated in FIGS. 2 and 3, a cleaning tool box includes a body 20 having a rear panel 10, left and right panels 12 and 14 and upper and lower panels 16 and 18 in order to open a front side thereof, a partition panel 22 positioned between the left panel 12 and the right panel 14 and assembled by the upper panel 16, the lower panel 18 and the rear panel 10 in order to partition an inner space of the body 20, a shelf 24 positioned between the upper panel 16 and the lower panel 18 and secured by left panel 12 and the partition panel 22 in order to partition an inner space of the body 20, a rag fixing rack 26 positioned at an upper end between the right panel 14 and the partition panel 22 to allow free access by a rag 200 and fixed by the shelf 24, the right panel 14 and the rear panel 10 to stably secure a handle at the rag 200, a rag pad 28 positioned between the rag fixing rack 26 and the lower panel 18 and fixed by the shelf 24 and the right panel 14 to allow a head of the rag 200 to be hitched thereat, two water containers 30 accommodated on floor of the body 20, and left and right doors 32 and 34 respectively assembled by the left panel 12 and the right panel 14 in order to open and close a front opening of the body 20 by way of opening and shutting method.

At this time, the rear panel 10, the left and right panels 12 and 14, the upper panel 16, the lower panel 18, the partition panel 22, the shelf 24, the rag fixing rack 26, the rag pad 28, left and right doors 32 and 34 are respectively standardized for assembly.

A plurality of round drafts 10*a* are respectively formed between the left panel 12 and the partition panel 22 or between the right panel 14 and the partition panel 22 relative to an upper side of the rear panel 10.

The rag fixing rack 26 is formed at a front surface thereof lengthwise each at a predetermined interval with a plurality of semi-circled hitching grooves 26*a* for a handle of the rag 200 to be securely held thereat.

The rag pad 28 of stainless steel rod shape is mounted at both ends thereof at central positions of entire breadth of the body 20 and simultaneously fixed to surfaces facing the partition panel 22 and the right panel 14 so as to be positioned lower than an entire central height of the body 20.

The two water containers 30 are opened at uppers thereof and one of them is positioned between the left panel 12 and the partition panel 22 relative to the floor of the body 20 while the other container is positioned between the right panel 14 and the partition panel 22 relative to the floor of the body 20. Unexplained reference numeral 40 defines an opening through which the rag 200 can access. At this location, the water containers 30 are made to be positioned lower than the height of rag pad 28.

In the construction thus described, when the rag 200 is inserted through the opening 40 provided at upper right side of the body 20, head part of the rag 200 is inserted into a space between the partition panel 22 and the right panel 14 relative to interior of the body to be hitched at the rag pad 28 mounted at a predetermined height, as shown in FIG. 3, while handle of the rag 200 is accommodated into one of the plurality of hitching grooves formed at the rag fixing rack 26, maintaining the rag 200 at a stable vertical state.

At this time, the head part of the rag 200 is hung toward the floor of the body 20 by intrinsic weight of the rag when it is hitched at the rag pad 28 and concurrently stays in the mid air in order to maintain a predetermined distance from an upper end of opening at the water container 30, such that filthy water and foreign objects remaining at the head of the rag 200 make free fall into the water container 30 and are collected thereat.

Furthermore, the rag 200 while in store at the body 20, is rapidly dried by current (air) coming and going through the plurality of drafts 10*a* formed at the rear panel 10, thereby being minimized in decomposition of the rag 200 and generation of stench therefrom, such that sanitary state of the body 20 can be further maintained.

Meanwhile, the water container 30 can be simple lifted for hand carry when the filthy water and foreign objects collected therein are emptied, such that there is no problem of splitting the filthy water and foreign objects collected in the container 30 and the containers 30 can be used for other purposes.

Furthermore, the rear panel 10, the left and right panels 12 and 14, the upper panel 16, the lower panel 18, the partition panel 22, the shelf 24, the rag fixing rack 26, the rag pad 28, left and right doors 32 and 34 are respectively standardized for assembly, such that mold-marking cost can: be saved to thereby reduce a manufacturing cost, replacement thereof is possible when each part is broken and coloring for each part can be varied to make an exterior look of the cleaning tool box beautiful.

As apparent from the foregoing, there is an advantage in the cleaning tool box thus described according to the present invention in that rear panel of a body is formed with a plurality of ventilations, a stainless steel rod-shaped rag pad touching a head part of rag is mounted at a predetermined height in the body to reduce contact sphere, and plural water containers are disposed on a floor of the body such that filthy water and foreign objects flowing from rag can be instantly emptied from the water containers.

There is another advantage in that drying efficiency of the rag is improved to remove generation of stench and to maintain a constant sanitary state.

What is claimed is:

1. A cleaning tool box, the box including a body comprised of a rear panel, left and right panels, upper and lower panels, and left and right doors for opening and closing a front opening of the body, the box comprising:

a partition panel positioned between the left panel and the right panel and secured by the upper panel, the lower panel and the rear panel in order to partition an inner space of the body;

a shelf positioned between the upper panel and the lower panel and secured by the left panel and the partition panel in order to partition an inner space of the body;

a rag fixing rack positioned at an upper end between the right panel and the partition panel and fixed by the partition panel, the right panel and the rear panel configured to allow unimpeded access by a rag and to stably secure a handle of the rag;

a rag pad positioned between the rag fixing rack and the lower panel and fixed by the partition panel and the right panel to allow a head part of the rag to be hitched thereat; and two water containers accommodated on a floor of the body.

2. The box as defined in claim 1, wherein a plurality of round drafts are respectively formed between the left panel and the partition panel or between the right panel and the partition panel relative to an upper side of the rear panel.

3. The box as defined in claim 1, wherein the rag pad is made of stainless steel and has a rod shape.

4. The box as defined in claim 1, wherein the rag pad is fixed to surfaces facing the partition panel and the right panel so as to be positioned lower than an entire central height of the body.

5. The box as defined in claim 1, wherein the two water containers are open at an upper portion and one of the water containers is positioned between the left panel and the partition panel relative to the floor of the body while the other water container is positioned between the right panel and the partition panel relative to the floor of the body.

* * * * *